US007938710B2

(12) United States Patent
Silverman et al.

(10) Patent No.: US 7,938,710 B2
(45) Date of Patent: May 10, 2011

(54) BREAST SHAPING AND LIFTING SUPPORT GARMENT

(76) Inventors: Yvonne M. Silverman, Melbourne Beach, FL (US); Robert J. Silverman, Melbourne Beach, FL (US)

( * ) Notice: Subject to any disclaimer, the term of this patent is extended or adjusted under 35 U.S.C. 154(b) by 12 days.

(21) Appl. No.: 12/507,787

(22) Filed: Jul. 22, 2009

(65) Prior Publication Data

US 2010/0022165 A1 Jan. 28, 2010

Related U.S. Application Data

(60) Provisional application No. 61/135,589, filed on Jul. 22, 2008.

(51) Int. Cl.
*A41C 3/00* (2006.01)

(52) U.S. Cl. ..... 450/67; 450/68

(58) Field of Classification Search ..... 450/67, 450/68, 66, 74, 75, 78; 2/67, 69, 102–106
See application file for complete search history.

(56) References Cited

U.S. PATENT DOCUMENTS 1,584,525 A * 5/1926 Freeman ..... 450/62
2,475,624 A * 7/1949 Laszlo ..... 450/63
2,488,105 A * 11/1949 Weil ..... 450/68
2,518,975 A * 8/1950 Chisholm ..... 450/62
2,543,984 A * 3/1951 Panes ..... 450/63
2,624,049 A * 1/1953 Granne ..... 2/114
3,030,961 A * 4/1962 Erteszek ..... 450/41
3,075,531 A * 1/1963 Clover ..... 450/67
3,710,800 A * 1/1973 Carey ..... 450/64
5,797,787 A 8/1998 Kaye
5,971,834 A 10/1999 Murray
D513,553 S 1/2006 Kaye
7,267,599 B2 * 9/2007 Allen et al. ..... 450/67

* cited by examiner

*Primary Examiner* — Gloria Hale
(74) *Attorney, Agent, or Firm* — John L. DeAngelis; Beusse Wolter Sanks Mora & Maire, P.A.

(57) ABSTRACT

A breast support garment. The garment comprises a right fabric panel for overlying the woman's right breast when worn, a left fabric panel for overlying the woman's left breast when worn, the right and the left panels having a relatively flat configuration when the garment is not worn, a first variable-length material strip attached to the right panel beginning at a region between the breasts and extending along a lower region of the right breast when the support garment is worn, a second variable-length material strip attached to the left panel beginning at the region between the breasts and extending along a lower region of the left breast when the garment is worn and the first and second material strips expanding when the garment is worn to allow the wearer's breasts to be received within cups formed in the right and left panels and further for providing lifting and upwardly directed forces on the right and left breasts as the first and second material strips attempt to return to their relaxed state.

5 Claims, 4 Drawing Sheets

BREAST SHAPING AND LIFTING SUPPORT GARMENT

CROSS-REFERENCE TO RELATED APPLICATIONS

The present application claims priority to a provisional application entitled Adjustable Lift Brassiere, filed on Jul. 22, 2008 and assigned application No. 61/135,589. The contents of the provisional application are hereby incorporated by reference.

BACKGROUND OF THE INVENTION

The present invention offers women an alternative support garment (i.e., a support garment including bra-like elements) or bra that comfortably lifts and shapes their breasts. The bra choices available today to women are basically limited to several variations on two primary designs, neither of which are considered comfortable or flattering. The bra is intended to control excessive movement of the breasts, which movement can cause discomfort. Conversely, the lack of proper support allows the soft tissue and ligaments of the breasts to stretch, leading to both general discomfort and breast sagging.

The first design is the traditional bra, with two pre-formed cups that attach to an elastic band that encircles the wearer's torso. The bra is typically adjustable in the rear of the torso. The bra and the breasts that it supports are held up by two shoulder straps.

The primary problem with this design is the pressure exerted on a lower region of the wearer's sternum (i.e., a pressure point) by the elastic band. In addition, the weight of the breasts resting in the bottom of the cups moves the joint between the two breast cups inward toward the breastbone, further increasing the force on the lower region of the breastbone. The discomfort is exacerbated by the continuous elastic band that encircles the wearer's torso in two segments hooked together in the back. This band typically has an adjustment mechanism (e.g., a plurality of spaced-apart hooks and mating loops) that allow a very limited adjustment in the length of the band and thus in the tension around the torso. But this adjustment does nothing to address the discomfort in the lower sternum area. While the bra's shoulder straps are also slightly adjustable to create more lift for the breasts, this variation also does nothing to shift the weight of the breasts away from the body and move the pressure point away from the sternum.

To support larger breasts, the cups' are typically reinforced with wire, that also presses uncomfortably against the torso due to the weight of the breasts. The underwires can also cause wear of the garment fabric as they rub against the bra fabric. The underwires may also break through the bra fabric, poking and chafing the wearer's skin and causing extreme discomfort.

The second prior art bra is the shelf bra. Bathing suits and sports bras may incorporate a shelf bra, for example. A shelf is constructed from an elastic band that attaches to fabric that overlays the wearers breasts. There are no pre-formed cups in this bra design. The wearer's breasts fall to the bottom of the shelf where they are supported by the shelf. The shoulder straps may be adjustable but the adjustment range is slight and the effect is one of moving the breasts inward toward the chest wall. The lack of pre-formed cups and the inwardly directed forces around the torso create a flattened breast appearance that is not flattering to the wearer. The shelf bra also does nothing to shape the breasts. Another problem with this bra design is the binding and compression created by the continuous elastic band encircling the torso. There is no adjustment mechanism to relieve tension exerted by the band that holds up the breasts. After wearing the bra for a short period, the wearer may find that it becomes uncomfortable due to the constricting elastic around the torso.

A patent issued to Kaye (U.S. Pat. No. 5,797,787) discloses a bra having drawstrings that tie below the breasts or at least in a line along a bottom surface of the breasts. See Kaye FIG. 3. Kaye is patentably distinct from the present invention, as further described below, as Kaye does not disclose any channels or material strips that extend between the breasts, that scoop under the breast and that extend upwardly along an outer-facing surface of each breast where they are anchored. The Applicants disclose several embodiments that teach these elements. Kaye discloses a continuous material band encircling the wearer's torso. But the Applicants' support garment comprises a non-continuous band of material strips or elastic with an opening in the band in the area of the lower sternum. The Applicants' teach a soft pliable cup formed from a variable length that bounds the cup (in a U-shape). The wearer's breasts are comfortably received within the cup without the use of any underwire supports or drawstrings such as disclosed by Kaye.

Obtaining a properly fitting bra is also problematic due to mass-production of bras in different but standard sizes. Each bra is sized according to chest circumference and symmetrical breast or cup size. Such symmetrical construction does not take into account asymmetries in the wearer's body nor accommodate changes in the woman's body over time (e.g., as a result of natural growth, pregnancy, childbirth, nursing and aging) or variations from standard sizes. A correctly sized bra may not properly fit two women with the same chest circumference and cup size. Thus even a correctly sized bra, based on cup size and chest circumference, will not provide a comfortable and properly supporting fit for all women. Bra adjustability is critical for accommodating variations in a individual's body, variations with time and variations between two individuals both of whom wear the same size bra.

One of the inventors has been unsuccessful in identifying a bra that fits comfortably. She has tried numerous designs and different sizes, but has always experienced discomfort, both with bras having an underwire and bras lacking an underwire, in the area at the base of the sternum between the two cups and local discomfort throughout the sternum area.

These negative experiences with current bra designs inspired the inventors to design a bra of the present invention that incorporates several desirable features, including no or reduced binding in the region of the sternum, a buoyant lift of the breasts away from the chest and in certain embodiments adjustable cup sizes.

BRIEF DESCRIPTION OF THE DRAWINGS

The present invention can be more easily understood and the advantages and uses thereof more readily apparent when the following detailed description of the present invention is read in conjunction with the figures wherein.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Figure 1:
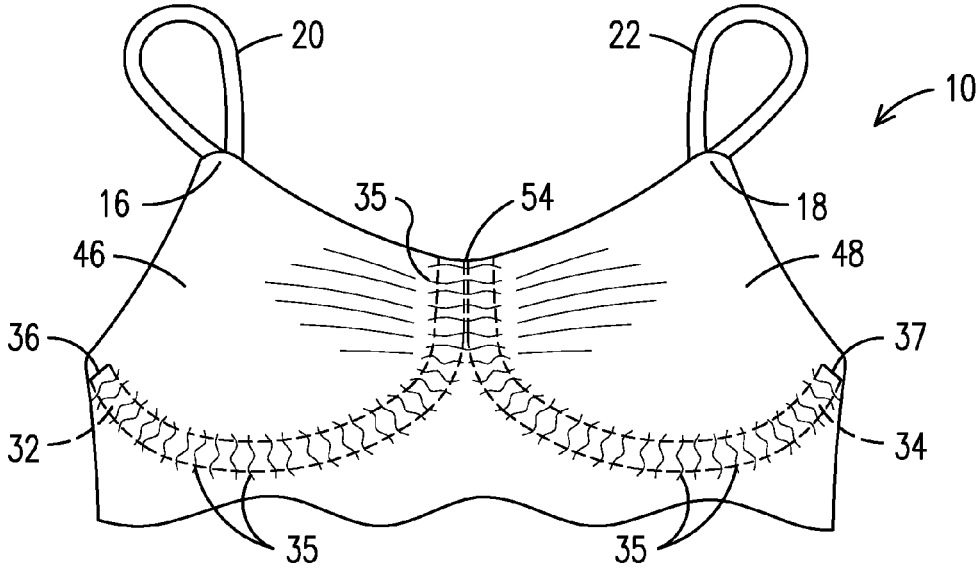
FIG. 1 illustrates a front view of a support garment of an embodiment of the present invention.

Before describing in detail the support garment of the present invention, it should be observed that the present invention resides primarily in a novel and non-obvious combination of elements. So as not to obscure the disclosure with details that will be readily apparent to those skilled in the art, certain conventional elements are presented with lesser detail, while the drawings and the specification describe in greater detail other elements and steps pertinent to understanding the invention.

The following embodiments and descriptions are not intended to define limits of the structure, elements and element interactions of the invention, but only to provide exemplary constructions. The embodiments are permissive rather than mandatory and illustrative rather than exhaustive.

The present invention offers a breast supporting and shaping garment that creates a flattering shape for the wearer's breasts and is also very comfortable to wear. The present invention creates this flattering shape by forming a soft cup only when the garment is worn. The support garment fits comfortably around a woman's breasts and eliminates pressure points associated with prior art bras. The support garment lacks a length of material that completely encircles the torso and thus there are no inwardly-directed forces as in the prior art bras. In particular, the inwardly directed forces are absent in the sternum area. This feature alleviates pressure on the sternum area, shifting the breast-supporting elements and the breast weight to the wearer's back and across the shoulder straps. Thus the present invention effectively solves the problems and discomfort of the prior art bras described above.

Unlike prior art bras, the breast supporting garment of the present invention includes no preformed cups for receiving the wearer's breasts. Instead, two soft relatively pliable cups are formed in material panels that generally cover each breast. The two cups are formed by compressive forces exerted by two variable-length material strips (e.g., elastic) that generally follow a partial circumferential contour of each breast, beginning at an side-facing surface (i.e., proximate and below the wearer's armpit) of each breast, scooping under each breast (this segment referred to as a lower circumferential segment) and extending upwardly into an area at least above a lower region of the sternum. The material strips may begin anywhere along the side-facing surface of each breast, but preferably they begin between about one-third and two-thirds of a distance between the bottom and top of the breast. The material strips are expanded by the woman's breasts when the garment is worn and each strip exerts lifting and outwardly directed forces on the breast as it attempts to return to its relaxed condition.

The various elements of the support garment embodiments of the present invention create a lifting force that shifts the weight of the breasts away from the lower chest, uplifting or suspending the breasts. These forces are primarily the result of three cooperating elements: the soft cups and the material strips that bound each cup, the shoulder straps, and for those embodiments that include one, a support band that extends from a region behind the breast area or below the armpit across the wearer's back.

Each variable-length material strip forming and bounding a breast cup has a general U-shape, with a breast disposed between the two legs of the "U" and resting on the base of the "U." One arm of each of the two U-shaped material strips (one material strip per breast) is disposed within the region between the two breasts. As can be appreciated, as upwardly directed forces are applied to the two legs of each "U" the breast is drawn upwardly. These forces are due in part to the elasticity of the variable-length material strip as it attempts to return to its relaxed condition. The shoulder straps also provide some uplifting forces.

For those embodiments that include a support band, one end of the band attaches at the side of a breast soft cup (i.e., approximately under the armpit), extends across the back and then forward to a side of the other breast cup. This support band effectively counters the downward weight of the breasts by distributing the weight upward and toward the back. This band also releases some weight from the shoulder straps. The support band may comprise variable-length material (elastic) or a material that is more rigid than a fabric material that forms the support garment.

In one embodiment, each material strip is disposed in a channel following the U-shaped contour as described above. A first end of each strip exits the channel in an area at least above a lower region of the sternum where the strips are releasably tied together or otherwise anchored (using a cord clip for example) to prevent withdrawal back into the channel and reduction of the uplifting forces. A second end of each strip is attached to the material of the garment along the outside-facing surface of each breast (e.g., approximately below each armpit).

Prior to anchoring the strips, the wearer pulls and/or loosens the material strips to apply the upwardly-directed forces to each breast and create cleavage as desired. This embodiment allows the wearer to independently adjust (tighten or release) the support for each breast, thereby controlling the forces exerted on each breast to reduce the wearer's discomfort and create a custom cup for each breast. The adjustment mechanism, in one embodiment located in the cleavage area, is easily accessible to the wearer.

In another embodiment the material strips are disposed within their respective channels as described herein, but in lieu of the strips exiting the garment to provide an adjustment mechanism, a first end of each strip is attached to the material of the garment (or otherwise permanently anchored) in the area at least above the lower region of the sternum. As in the embodiment described immediately above, a second end of each strip is attached to the material of the support garment along the outside-facing surface of each breast (e.g., approximately below each armpit). The wearer's breasts exert a force against the material of the garment thereby extending a length of the variable-length material. Pressure is applied to shape and lift the breasts as each variable-length material strip attempts to return to its initial state.

In yet another embodiment, in lieu of disposing the material strips in channels, the variable-length material strips are attached (by sewing for example) to the material of the garment. In this embodiment the strips are first tensioned or expanded and while in this state are attached to the material of the garment. When the tension forces are removed, the strips and the garment material revert to a gathered or puckered condition. Subsequent application of a tension force to the strips causes them to expand and exert a force that attempts to return the strips (and the garment to which they are attached) to their relaxed (gathered) condition. The variable-length material strips of this embodiment generally follow the same path as the material strips of the other embodiments described herein.

The new and novel designs for creating the breast cups and lifting the breasts shift the weight of the breasts upward and away from the sternum to alleviate pressure in this area. Since the present invention does not include a continuous band extending across both breasts and extending between the breasts as in the prior art, the support garment of the present invention does not create a force against the lower region of the sternum. By eliminating this band and the inwardly-directed force that it exerts, the support garment of the present invention reduces or eliminates the pressure on the lower sternum area.

The present invention effectively lifts and shapes a woman's breasts in a comfortable and flattering way. Prior art bras have included several variations of two basic designs; the traditional bra and the shelf bra, as described above, both of which support the wearer's breasts from below. The present invention creates a breast support system that effectively lifts and suspends the wearer's breasts upwardly and moves the support point away from the sternum area. With the weight of the breasts suspended away from the sternum, creating a space between the support garment and the sternum, the force exerted on the breastbone and especially on a lower region of the breastbone is reduced if not eliminated.

These designs create a marked improvement in wearer comfort. There is no continuous torso-encircling band to support the breasts from below and exert an inwardly directed force against the sternum. Instead, the support garment of the present invention provides lift and shape elements and shifts the weight of the breasts upward and across the wearer's back to distribute support to the top of the torso and to the back. The support garment essentially creates a suspension system that effectively supports the woman's breasts from above rather than from below as in the prior art bras. The overall, feeling to the wearer is one of buoyancy and weightlessness, which results in an exceptionally comfortable and flattering support garment. The garment of the present invention uniquely and comfortably covers, shapes, and supports a woman's breasts without creating binding or pressure points on the wearer's torso, particularly in the ribcage and sternum areas.

FIG. 1 illustrates a first embodiment of a garment constructed according to the teachings of the present invention. A material of a garment 10 (only an upper region of the garment 10 is illustrated) comprises a stretchable or elastic material, such as cotton or spandex, or any combinations of fabrics that are generally soft (for comfort) and stretchable (i.e., at least stretchable to some extent although the degree of stretch is not critical to proper functioning of the garment).

A front surface of the garment 10 comprises right and left panels 46 and 48. These panels have a generally flat shape when the garment is not being worn. When the garment is worn, the right and left panels 46 and 48 cover and support the wearer's right and left breasts and attachment regions 16 and 18 (for attaching shoulder straps) are proximate an upper region of the respective right and left breasts.

Shoulder straps 20 and 22 extend from respective front attachment regions 16 and 18 of the right and left fabric panels 46 and 48 across each shoulder and downward along the back for attaching to a rear surface (not shown) of the garment 10. This rear surface attachment points are typically disposed below the shoulder blades. The shoulder straps 20 and 22 may be constructed of an elastic or non-elastic (i.e., having a fixed inextensible length) material. The shoulder straps 20 and 22 may also comprise a length-adjusting mechanism, as is well known in the art. The should straps 20 and 22 may each also comprise an opening/closure element (not shown in the Figures) for releasing the shoulder straps from either a front or back attachment point.

Various shoulder strap designs may be used with the support garment of the present invention, including shoulder straps that cross along the wearer's back and shoulder straps that wrap around the neck, such as in a halter-type bra.

Unlike prior art support garments, the garment of the present invention includes no preformed cups for receiving the wearer's breasts. According to one embodiment, variable-length material strips 32 and 34 (e.g., elastic) are tacked or sewn to a material of the support garment 10, while the garment material is puckered or gathered, with material gathers or puckers represented by reference character 35, to allow for expansion of the garment material (and the material strips) when the garment 10 is worn. Generally, a length of the material strips 32 and 34 is determined and the garment material is gathered such that upon expansion of the material strips 32 and 34 and extension of the gathered material when the garment is worn, cups are formed of an adequate size to comfortable receive the woman's breasts. While the garment is worn and the material strips 32 and 34 attempt to return to their relaxed state or length, the strips 32 and 34 exert upward and outward forces to the breasts, leaving the woman with a sense that her breast are buoyant.

Each strip 32 and 34 begins at a region 54 between the breasts and generally above the sternum where each strip is separately attached to the material of the garment. In one embodiment the strips 32 and 34 may be spaced apart by about one inch. From the region 54 the strip 32 continues along the sternum to a lower surface of the right breast (i.e., a margin between the chest and the bottom surface of the breast) to a region 36 where the strip 32 terminates. The strip 34 follows a similar path relative to the left breast to a region 37. Generally, the strips 32 and 34 extend from the region 54, downwardly between the breasts and around a lower circumferential segment of each breast.

In one embodiment the regions 36 and 37 are on a side surface of each breast; in another embodiment eth regions 36 and 37 are below each arm pit. In still another embodiment, not illustrated, the material strips 32 and 34 are not terminated at the regions 36 and 37 but instead continue under the respective right and left armpits and across the back where the strips 32 and 34 are joined to form a continuous strip.

Figure 2:
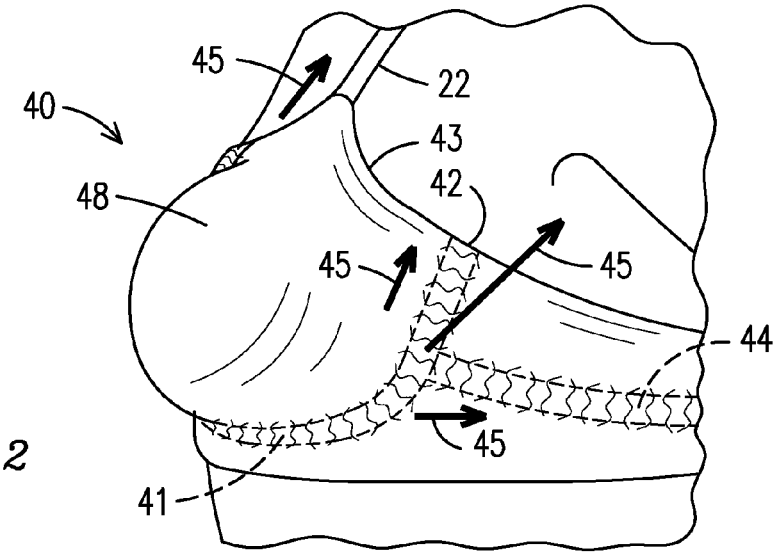
FIG. 2 illustrates a side view of a support garment having a band that extends across the wearer's back.

According to another embodiment of a support garment, the material strips do not terminate at the regions 36 and 37 as illustrated in FIG. 1, but instead continue upwardly back to a top edge of the support garment. FIG. 2 illustrates a support garment 40 comprising a variable-length material strip 41 (only the left material strip illustrated in the side view of FIG. 2) extending to a region 42 on an upper edge 43 of the garment 40. A material strip 44 meets the material strip 41 as illustrated proximate an outside edge of the left cup, extends along the back of the garment 40 and returns to the front to meet a material strip encircling a lower region of the right breast. The material strips 41 and 44 (and corresponding material strips supporting the right breast) support each breast both below and laterally.

In one embodiment as illustrated, the material strips 41 and 44 (and the material strips associated with the right breast) are tacked or sewn to the material of the support garment 40, like the material strips 32 and 34 of FIG. 1. In another embodiment (not illustrated) the material strips 41 and 44 (and the material strips associated with the right breast) are disposed in channels formed within the garment 40, instead of being tacked to the material of the garment.

The material strip 44 meets the material strip 41 between approximately one-third and two-thirds along the outer edge of each cup. However, the location of the intersection is not critical to proper functioning of the support garment 40.

FIG. 2 also illustrates approximate location of force vectors 45 that create the uplifting forces on the left breast. Similar force vectors act on the right breast. As can be seen, the predominant direction of the force vectors is upwardly directed. These force vectors are due to the cooperation and position of the material strips.

Figure 3B:
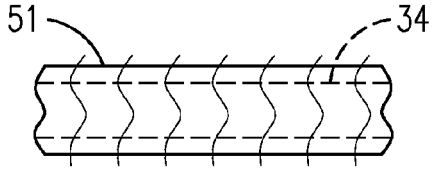
FIGS. 3A and 3B illustrate views of a support garment of another embodiment of the present invention.
Figure 3A:
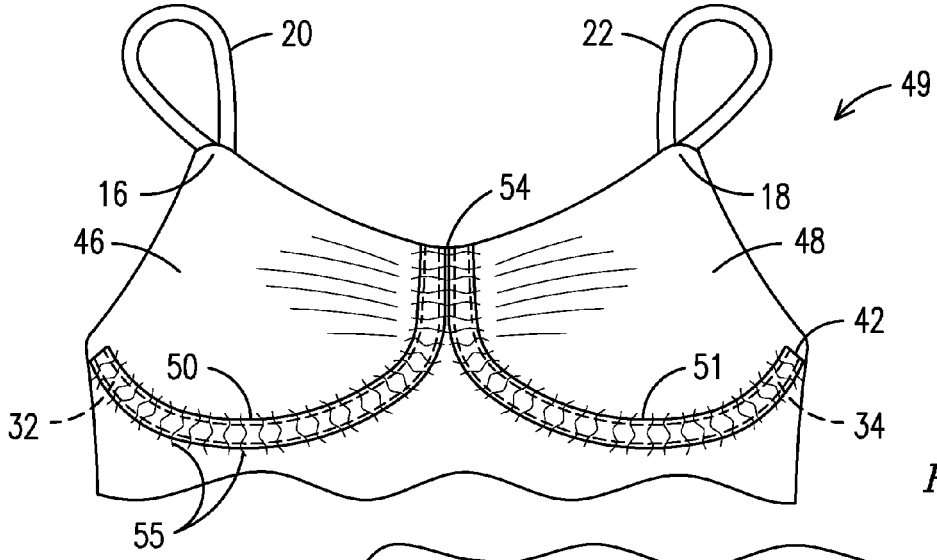

In yet another embodiment illustrated in FIGS. 3A and 3B, in a support garment 49 the material strips 32 and 34 are enclosed in respective channels 50 and 51 that extend around a lower circumferential segment of each breast.

The channels 50 and 51 begin at the point 54 between the breasts and generally above the sternum when the garment is worn. The channel 50 continues to the lower surface of the right breast (i.e., the margin between the chest and the bottom surface of the breast), extends under the right armpit, across the back, back toward the front below the wearer's left armpit, and back to the front surface of the garment 10 where the channel is identified by a reference character 51 in FIG. 3A. Both variable-length material strips 32 and 34 are affixed to the garment at the point 54.

When a woman wears the support garment, her breasts exert a force against the material of the garment thereby extending the length of the variable-length material strips. Pressure is applied to shape and lift the breasts as the variable-length material strips attempt to return to their initial configuration.

The material strips 32 and 34 may be disposed within the respective channels 50 and 51 in a relaxed state, or the material strips 32 and 34 may be disposed within the respective channels 50 and 51 in a biased state. To accomplish the biased state, a length of the material strips 50 and 51 is made shorter than the channel the material strip will occupy. The material strips 50 and 51 are threaded into the channel. But because of the length differential, the material strip must be tensioned (stretched) to allow it to be anchored or otherwise attached to the garment material at both ends of the channel. When the tension is released, the material strips return to their relaxed state and the garment material proximate the channel puckers.

In an alternative embodiment the channels 50 and 51 (and the material strips 32 and 34 enclosed therein) do not extend across the wearer's back, but instead terminate at the region 42 in FIG. 3A for the left breast (and a similar area for the right breast) where the material strip 34 is affixed to the garment.

Figure 4:
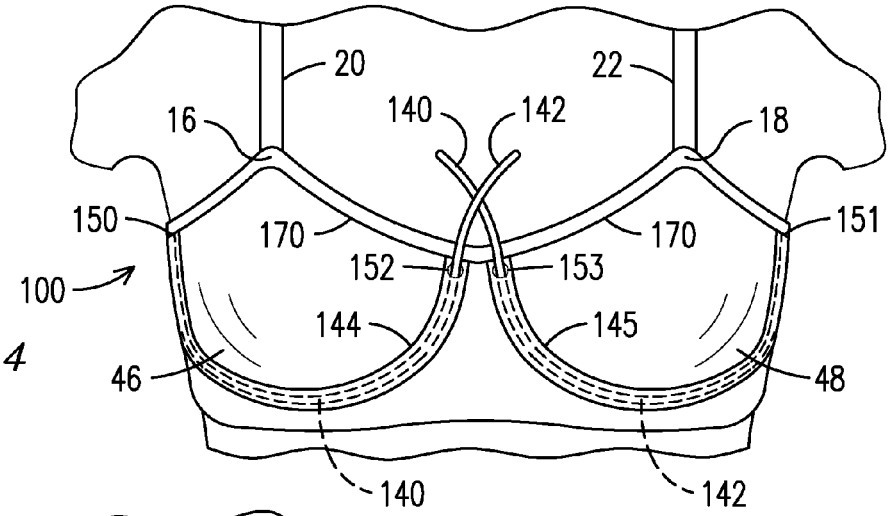
FIGS. 4, 5 and 6 illustrate front, side and rear views of a support garment of another embodiment of the present invention.
Figure 5:
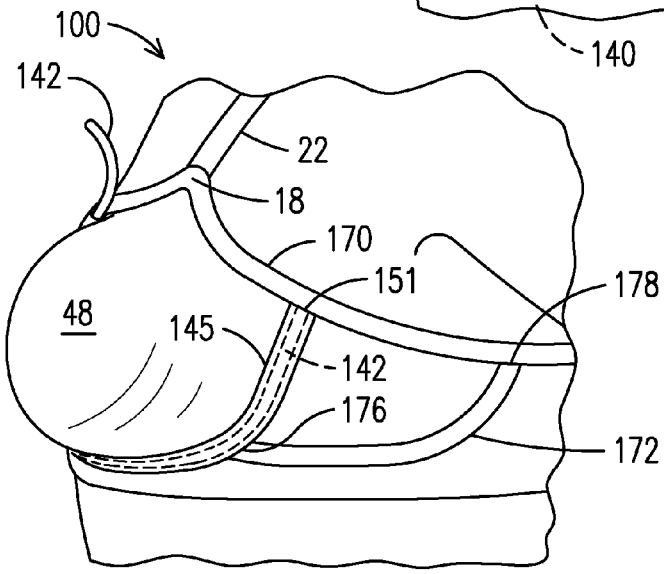
Figure 6:
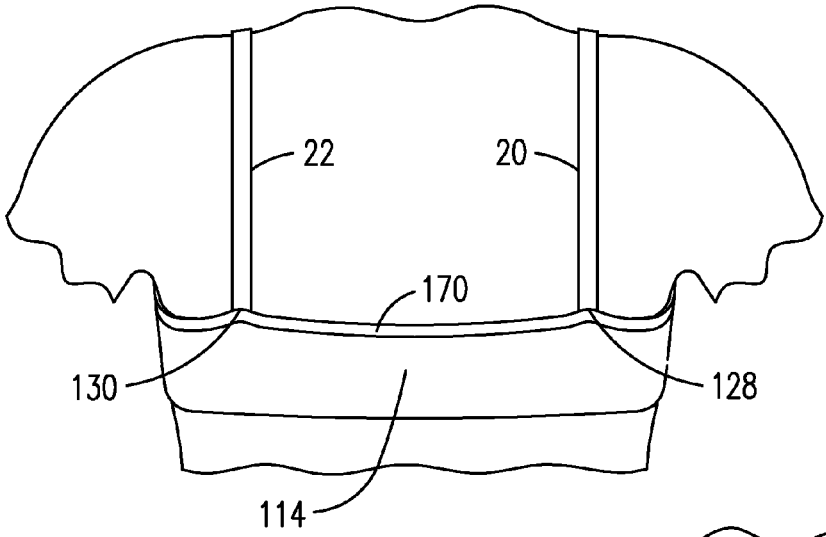

FIGS. 4, 5 and 6 illustrate a support garment 100 that comprises two independently adjustable and variable-length material strips 140 and 142, in lieu of the material strips 32 and 34 of FIGS. 1, 2A and 2B. The material strips 140 and 142 are slidable within respective channels 144 and 145 formed within respective right and left panels 46 and 48. Since the material strips 140 and 142 comprise variable-length material, they can also be extended (expanded) or permitted to compress within the respective channel 144 and 145. The channels 144 and 145, like the channels 50 and 51 of FIG. 2A, may be formed between spaced-apart stitches or seams, for example. When the support garment is worn, the channels 144 and 145 extend from respective right and left regions 150 and 151 (located at a side region of each breast) downwardly below each breast and upwardly into a cleavage region between the breasts.

Each material strip 140 and 142 is disposed within one of the channels 144 and 145 with a first end of each strip 140 and 142 protruding through the respective channel at holes 152 and 153 in the cleavage region. In one embodiment, not illustrated, the channels 144 and 145 and the materials strips 140 and 142 disposed therein may cross in the cleavage area or at the top of the sternum. This feature may be helpful in creating additional structure to support heavier breasts and also may prevent the strips from accidentally sliding back into the channels.

Once properly adjusted to support and shape the wearer's breasts as desired, the variable-length material strips 140 and 142 can be tied or cinched together or otherwise clamped to prevent withdrawal of the strips 140 and 142 back into the respective channels 144 and 145 with consequent loss of the breast support. In one embodiment the holes 152 and 153 are disposed on an inside surface of the garment 100 allowing the wearer to hide the tied material strips 140 and 142. In another embodiment the tied material strips may form a decorative element of the support garment.

The support garment 100 further comprises a rear torso band 114 that in one embodiment extends along the wearer's back. The shoulder straps 20 and 22 attach to the rear torso band 114 at respective rear attachment regions 128 and 130. The rear torso band 114 may comprise an elastic material or a material of an inextensible length with or without a length-adjusting mechanism. An opening/closure element (not shown in the Figures) may also be present in the rear torso band 114.

A second end of each material strip 140 and 142 is anchored at a respective right and left region 150 and 151 located at a side region of each breast proximate a margin between the breast and the chest wall (i.e., below and forward of the wearer's armpit). Anchoring may be achieved by sewing or clamping the second end of each strip 140 and 142 to its respective region 150 and 151. From the regions 150 and 151, the material strips 140 and 142 extend within the channels 144 and 145 to the channel openings 152 and 153 as described above.

Each of the openings 152 and 153 may be reinforced with a grommet, a metal or plastic ring or stitching (not shown in the Figures) to prevent the garment material from unraveling.

The material strips 140 and 142, like the material strips 32 and 34, may comprise a string-like, shoelace-like or ribbon-like element, a flat or circular band, an elastic material, an inextensible material or any combination of these and other suitable materials. In one embodiment each strip 32, 34, 140 and 142 includes a first segment having an inextensible length coupled to a second extensible segment. For one embodiment, a distal end of the second extensible segment is affixed to material of the garment at the anchor regions 150 and 151. For example, in one embodiment about two inches of each material strip 140 and 142, measured from the anchor regions 150 and 151, comprises an elastic or variable length segment. In another embodiment the material of the first and second segments of the material strips 140/142 is reversed, i.e., the first segment protruding through the openings 152 and 153 is extensible and the second segment is inextensible.

When the support garment 100 is worn, the wearer manipulates (e.g., cinches, draws, loosens) the material strips 140 and 142 to form cups within the right and left panels 46 and 48 for scooping and supporting the breasts. The support garments of the various presented embodiment are relatively flat when not being worn. For the support garment 100, the wearer can adjust the cup size, shape, position and lifting forces on the breasts by independently cinching or loosening each of the two support elements 140 and 142 before they are individually tied or clamped (together or separately) in the cleavage area (i.e., near a top region of the sternum). Independently tightening or loosening the material strips 140 and 142 allows the wearer to independently control the magnitude and direction of the forces and the support exerted on each breast and the surrounding tissue. This adjustment mechanism also moves the fabric of the support garment away from the sternum and reduces the pressure experienced in that region.

The wearer ties or fastens the material strips 140 and 142 together to hold the strips in a desired relative length and tension. Various types of known cord locks, cord clips, cord stops or other joining elements, such as a Velcro®, may be used to maintain the relative position and tension on the strips 140 and 142. This unique design allows the wearer to independently lift, shape, and/or release the breast support according to her desire, by manipulating the material strips 140 and 142 in the front of the support garment 100 without having to remove the garment or purchase a support garment of a different size.

Figure 7:
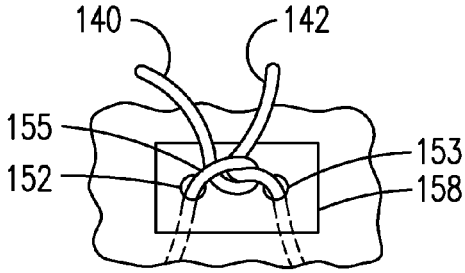
FIGS. 7, 8 and 9 illustrate elements for holding the material strips of FIGS. 4, 5 and 6.
Figure 8:
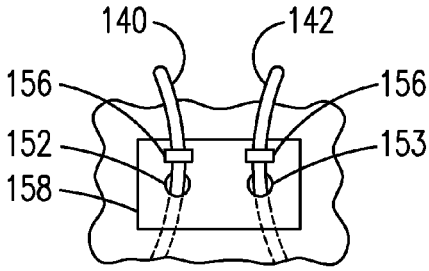

FIGS. 7 and 8 illustrate a respective knot 155 and clamps 156 for holding the material strips 140 and 142 in the desired configuration.

FIGS. 7 and 8 also illustrate a support bridge 158 that may be present in one embodiment of the support garment 100. The support bridge 158 is disposed in a region where the material strips 140 and 142 exit the openings 152 and 153. The support bridge 158 (e.g., a stiffening element) provides extra strength and stability for the fabric in the region of the openings 152 and 153. This stabilizing effect may provide additional support for large-breasted women. The bridge 158 may also reduce the likelihood of tears and rips in this region due to the forces created when the material strips 140 and 142 are tied or clamped.

In one embodiment the support bridge 158 comprises a rigid material with openings therein aligned with the respective garment openings 152 and 153. When installed in a support garment of the present invention, the support bridge 158 may be sewn into the fabric. In other embodiments the support bridge 158 may comprise additional cloth layers, multiple thread stitches, elastic, plastic, etc.

Typically when the support garment 100 is worn, the support bridge 158, and therefore the tie or fastening point for the material strips 140 and 142, is located proximate an upper region of the sternum or above the sternum. Since the primary forces on the support bridge 158 are due to the weight of the breasts and the material strips 140 and 142 that support that weight, and those forces are directed outwardly away from the wearer's chest, (rather than directed inwardly as in the prior art support garments), the pressure experienced by the wearer in the sternum region is drastically reduced if not eliminated.

Figure 9:
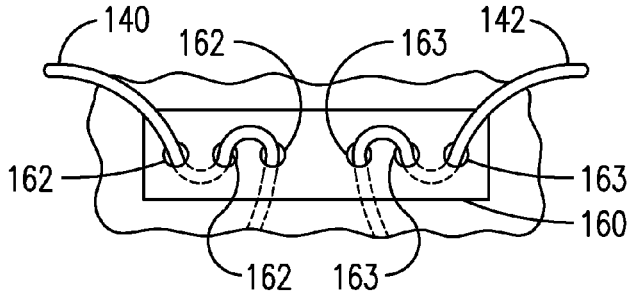

In another embodiment, a support bridge 160 (see FIG. 9) comprises multiple openings 162 and 163 to provide another adjustment mechanism for the wearer. The wearer can select the openings 162/163 through which the material strips 140 and 142 pass. The wearer may also thread the material strips 140 and 142 through multiple holes 162 and 163 in the support bridge 160 to create additional holding forces for the material strips 162 and 163. These additional openings may be especially beneficial for wearer's with heavy breasts.

As the material strips 140 and 142 are lifted and cinched and partially encircle the breasts, the fabric of the right and left panels 46 and 48 forms and shapes a cup around each breast and the breasts are lifted and supported. Further, the amount of loosening or cinching of each strip 140 and 142 can be adjusted relative to the amount of loosening or cinching applied to the other materials strip. Each strip can be independently adjusted. The support garment 100 thus supports and lifts the formed cups around the breasts and scoops the breasts to create the desired amount of cleavage. Since the breasts are lifted from below by the material strips 140 and 142 (and the material strips 32 and 34), the support garments of the various embodiments of the present invention do not require a tight circumferential fit about the wearer's chest to support the breasts. This substantial reduction in the circumferential forces reduces, or even eliminates, any pressure on the wearer's sternum.

It is noted that a support garment that supports the breasts only from below, i.e., either a shelf bra or one that uses ties or support elements that extend only under the breasts (that is, where a lower surface of the breasts meets the chest wall) does not provide any components or elements for lifting and shaping the breasts or for increasing or decreasing breast cleavage. Only the support garments of the various embodiments of the present invention provide the lifting (upwardly directed) forces on each breast.

In addition to the breast support provided by the material strips, a support garment of the present invention constructed from an elastic material may provide additional support. For example, when the garment is worn, the encircling of the breast causes the elastic garment material to exert supporting forces on the breasts.

Returning to FIGS. 4-6, the support garment 100 further comprises a support element 170 extending from the attachment region 18 downwardly along an upper region of the left breast, below the left armpit, onto the rear torso band 114, across the back, under the right armpit, upwardly toward the right breast to the attachment region 16, downwardly to the cleavage area and upwardly back to the attachment region 18. A material of the support element 170 comprises a rigid, flexible, variable-length (e.g., elastic) or fixed length (e.g., inelastic) material. In certain embodiments the support element 170 is not present, in particular in embodiments where the elements of the invention are incorporated into pajamas and small size garment tops.

A left-side support element 172 (see FIG. 5) extends from a region 176 proximate a lower surface of the left breast to a region 178 proximate or intersecting with the support element 170. As can be seen, the region 178 is disposed along a side surface of the wearer's chest below the armpit. The left-side support element 172 may be attached to a material of the support garment in the region 176 and may be attached to the material of the support garment or to the support element 170 in the region 178.

A right-side support element follows a similar path from a region proximate a lower surface of the right breast to an intersection point with the support element 170. The right-side support element is not shown in the Figures. The support element 170, the left-side support element 172 and the right-side support element can comprise a strip-like or string-like material having elastic or a inelastic (having a relatively fixed length) properties.

In another embodiment, the region 178 where the support element 172 meets the support element 170 (and a corresponding region on the wearer's right side) is closer to the wearer's back. In still another embodiment the region 178 is moved closer to the breast.

As described herein, the present invention comprises a support garment that allows the wearer to comfortably and incrementally (in the adjustable embodiment) lift, shape, cover, and support each breast while creating little or no pressure or binding around the ribcage or sternum, unlike any bras that are known in the prior art. Also, when not worn, the front surface of the support garment has a generally flat configuration.

Figure 10:
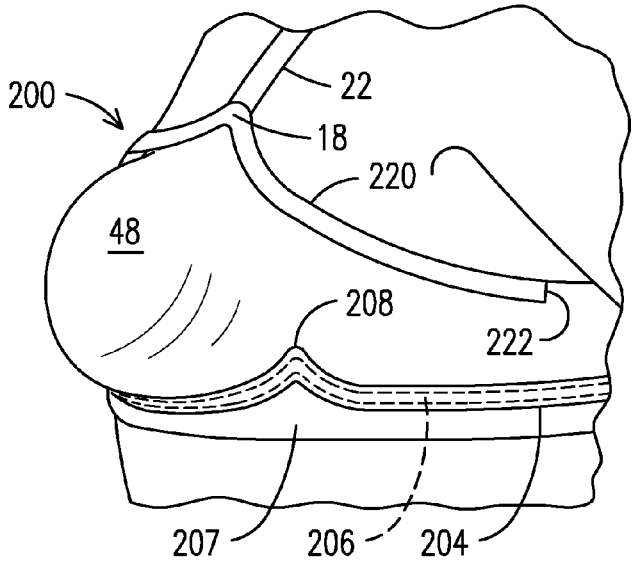
FIGS. 10 and 11 illustrate side and rear views of a support garment according to another embodiment of the present invention.
Figure 11:
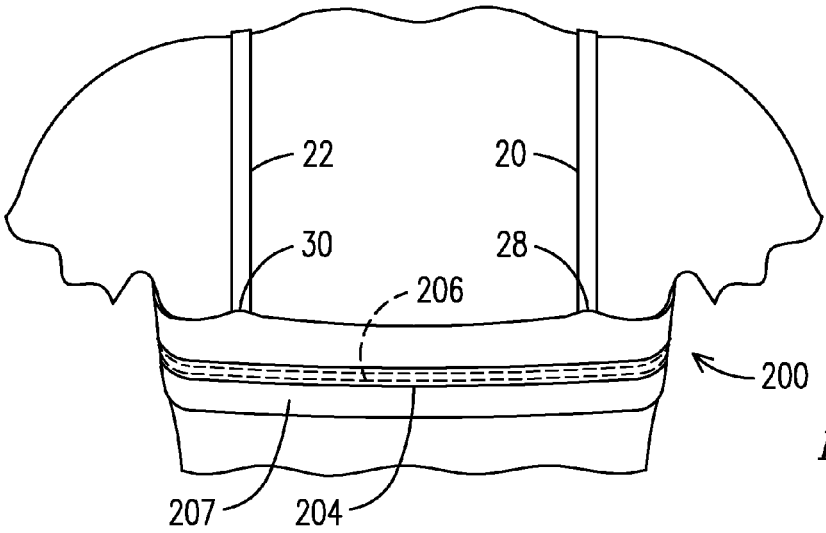

FIGS. 10 and 11 illustrate another embodiment of a support garment 200 of the present invention. As can be seen in FIG. 10, a variable-length material strip 206 is carried within a channel 204. As further illustrated in FIG. 10, the channel 204 and the material strip 206 begin in the cleavage area, extend beneath the left breast and rise to an apex 208. From the apex 208, the channel 204 and the material strip 206 descend to a region immediately above a torso band 207 along a left chest sidewall, continue to a rear portion of the torso band 207 then back to the cleavage area following a path along the right breast that is symmetrical to the path along the left breast. Only a left side of the path is illustrated in FIG. 10.

The support garment 200 permits adjustment of the cups as in other described embodiments. Additionally, with the continuous material strip 206 extending across a rear segment of the torso band 207, the wearer can adjust the pressure exerted on her back. This feature may be particularly useful for pajamas incorporating the support garment of the present invention. It is noted that the embodiment of FIGS. 10 and 11 may offer less breast shaping as this embodiment lacks support along the entire length of the side of each breast, which support is provided by certain of the embodiments described above.

The support garment 200 further comprises an upper support element 220 extending along an upper region of the left breast (the right upper support element and the right breast are not illustrated in FIG. 10 or 11) and terminating at a region 222 beneath the wearer's left armpit. The support element 220 can comprise an elastic (extensible) or a non-elastic (having a relatively fixed length) material.

In another embodiment of the present invention the support element 220 and the support element above the right breast are not present.

Figure 12:
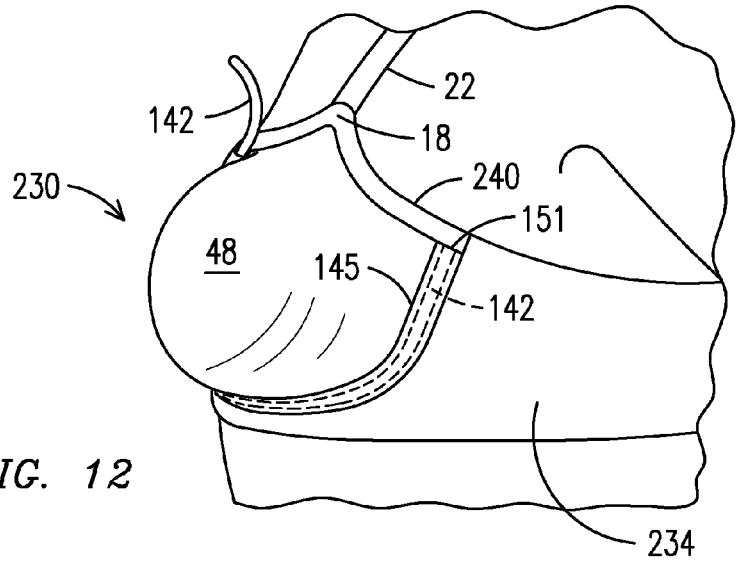
FIGS. 12 and 13 illustrate side and rear views of a support garment according to another embodiment of the present invention.
Figure 13:
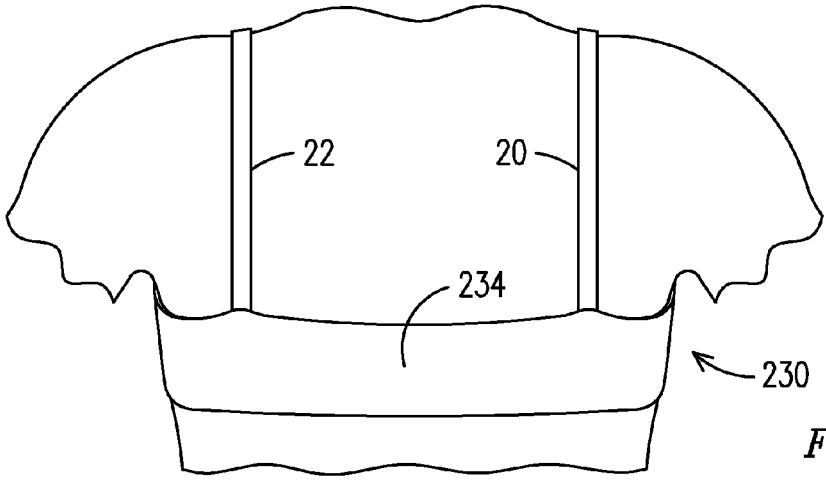

FIGS. 12 and 13 illustrate another embodiment of a support garment 230 of the present invention, including an upper support element 240 extending from the sternum area along an upper region of the left breast to the region 18 and terminating at a junction with the channel 145 (for carrying the support element 142) at the region 151. A similar support element extends relative to the right breast. The support garment 230 permits adjustment of the cup 48 as described above in conjunction with other embodiments. The material strip 142 (and the material strip 140 not illustrated) can comprise an elastic (extensible) or a non-elastic (having a relatively fixed length) material or a combination of both material types.

The support garment 230 further comprises a rear torso band 234 illustrated in FIG. 13.

In the embodiments described above, the channels and/or material strips in the cleavage area are depicted as adjacent each other. This is not necessarily required as in other embodiments the channels and/or material strips may terminate at spaced-apart regions, e.g., separated by an inch or more.

Any of the support garments described herein can be incorporated into any woman's garment, including but not limited to a bra, sports bra, swimsuit, exercise top, camisole, nightgown or pajamas.

In other embodiments, access to the material strips for exerting pressure to shape and support the breasts can be gained at locations other than in the sternum area as illustrated.

In another embodiment an adjustment mechanism may be present in the various illustrated rear torso bands. This mechanism may permit the wearer to tighten or loosen the pressure exerted on the torso and thereby permit further comfort adjustments for the support garments.

The various described embodiments of the support garment differ from prior art bras due to the lack of a continuous torso band in the inventive support garments. These support garments lack a torso band in at least the frontal area below the breasts, where all prior art bras disclose a torso band. The lack of a torso band in the garment front reduces or eliminates the forces exerted on the sternum (breast bone), while the support garment of the present invention relies on other elements and features, as described above, to shape and uplift the breasts.

Although referred to as material strips in the present description, in various embodiments each material strip may comprise string, cord, elastic material, a material having a non-extensible length, cloth or a combination of any material. The material strips may comprise a circular or rectangular (relatively flat) cross-section. Also, with one end of each material strip anchored, manipulation of the other end, in those embodiments including this feature, allows the breast to be supported and scooped as desired.

The term "support garment" when used herein is intended to include clothing worn on the wearer's torso, such as dresses, blouses, bras, slips, frocks, leisure suits, sleepwear, nightgowns, bathing suits, sports bras, for any purpose and at any time, including both day and night use.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims or if they include equivalent structural elements with insubstantial differences from the literal languages of the claims. For example, the material of the various elements of the invention may comprise any suitable material that can perform its intended function as described herein. For certain elements of the invention, elastic material may be substituted for inelastic material and vice versa. Also, elements from one embodiment of the invention may be combined with or substituted for other elements from other embodiments of the invention.

What is claimed is:

1. A breast support garment comprising:

a right fabric panel for overlying the woman's right breast when worn;

a left fabric panel for overlying the woman's left breast when worn;

the right and the left panels having a relatively flat configuration when the garment is not worn;

a first variable-length material strip attached to the right panel beginning at a region between the breasts and extending along a lower region of the right breast when the support garment is worn;

a second variable-length material strip attached to the left panel beginning at the region between the breasts and extending along a lower region of the left breast when the garment is worn;

the first and second material strips expanding when the garment is worn to allow the wearer's breasts to be received within cups formed in the right and left panels and further for providing lifting and upwardly directed forces on the right and left breasts as the first and second material strips attempt to return to their relaxed state; and a rear torso band connected to the right and left panels and extending across a wearer's back, the first and second material strips each continuing from a lower region of each breast along the rear torso band.

2. The support garment of claim 1 the rear torso band comprising a closure system configurable to a closed state when the support garment is worn and configurable to an open state for removing the support garment from the wearer's body.

3. A breast support garment comprising:

a right fabric panel for overlying the woman's right breast when worn;

a left fabric panel for overlying the woman's left breast when worn;

the right and the left panels having a relatively flat configuration when the garment is not worn;

a right channel within the right panel, when worn the right channel extending from a first end between the left and the right breasts, downwardly under the right breast and upwardly to a second end proximate a right side of the right breast;

a left channel within the left panel, when worn the left channel extending from a first end between the left and the right breasts, downwardly under the left breast and upwardly to a second end proximate a left side of the left breast;

a right variable-length material strip within the right channel;

a left variable-length material strip within the left channel;

wherein when the support garment is worn, the right and left material strips encircle a lower portion of the respective right and left breasts, are in tension and exert uplifting forces on the respective right and left breasts;

a rear torso band connected to the right and left panels and extending across a wearer's back; and a support band within a channel defined in the torso band, the support band extending from a left side region of the left breast, across the wearer's back to a right side region of the right breast, wherein the support band comprises a first segment of elastic material and a second segment of inelastic material, or an entire length of elastic material or an entire length of inelastic material.

4. The support garment of claim 3 wherein the left side region of the left breast comprises a point between about one-third and two-thirds of the distance from a bottom to a top of the left breast, and wherein the right side region of the right breast comprises a point between about one-third and two-thirds of the distance from a bottom to a top of the right breast.

5. The support garment of claim 3 wherein the right material strip is anchored at the first and second ends of the right channel and the left material strip is anchored at the first and second ends of the left channel, the support garment further comprising a rear torso band connected to the right and left panels and extending across a wearer's back, a support band within a channel defined in the torso band, the support band extending from a left side region of the left breast, across the wearer's back to a right side region of the right breast.

* * * * *